US006327900B1

(12) United States Patent
Mc Donald et al.

(10) Patent No.: US 6,327,900 B1
(45) Date of Patent: Dec. 11, 2001

(54) OIL LIFE MONITOR FOR DIESEL ENGINES

(75) Inventors: John E. Mc Donald, Grosse Pointe Woods; Ellen Shirley Schwartz, Warren; Nshan Hamparian, Troy; Michael Jacek, Livonia; Joseph M. Stempnik, Warren; Scott John Fletcher, Haslett, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/467,499

(22) Filed: Dec. 20, 1999

(51) Int. Cl.[7] ..... G01L 3/26
(52) U.S. Cl. ..... 73/117.3; 701/30
(58) Field of Search ..... 73/117.3, 116, 73/118.1; 701/30; 340/438, 439

(56) References Cited

U.S. PATENT DOCUMENTS

| | | | | |
|---|---|---|---|---|
| 4,839,831 | * | 6/1989 | Imajo et al. | 73/117.3 |
| 5,060,156 | * | 10/1991 | Vajgart et al. | 701/30 |
| 5,382,942 | * | 1/1995 | Raffa et al. | 340/439 |
| 5,530,647 | * | 6/1996 | Sem et al. | 701/30 |
| 5,633,796 | * | 5/1997 | Cullen et al. | 340/438 |
| 5,642,284 | * | 6/1997 | Parupalli et al. | 73/117.3 |
| 5,750,887 | * | 5/1998 | Schricker | 73/117.3 |
| 6,032,100 | * | 2/2000 | Forfitt et al. | 702/1 |
| 6,037,864 | * | 3/2000 | Sem et al. | 340/679 |

* cited by examiner

*Primary Examiner*—George Dombroske
(74) *Attorney, Agent, or Firm*—George A. Grove; Leslie C. Hodges

(57) ABSTRACT

A method for advising a motor vehicle operator of the need to change the lubricating oil in a direct or an indirect injection diesel engine. The rate of degradation of the engine oil is determined from monitoring engine revolutions, engine oil temperature and engine oil contamination content. At the start of service after an oil change has occurred, a value corresponding to the maximum allowed number of engine revolutions for the useful life of the oil is stored in the memory of the vehicle's computer. Periodically during each period of vehicle operation, an effective engine revolutions value is determined in relation to the product of measured engine revolutions, an engine oil temperature dependent penalty factor and an oil contaminant content dependent penalty factor. The penalty factors increase the effective engine revolutions value to compensate for engine operating conditions that tend to cause increased degradation of the engine oil. The effective engine revolutions value is subtracted from the stored maximum number of engine revolutions resulting in a remaining allowed revolutions value. Each time the effective engine revolutions value is calculated and subtracted from the remaining allowed engine revolutions value, a new remaining allowed revolutions value is stored in memory, replacing the old value. When the stored remaining allowed revolutions value is decreased below a predetermined threshold value indicating the end of the oil's useful life, an indicator advising the operator that the engine oil needs to be changed is activated.

7 Claims, 4 Drawing Sheets

OIL LIFE MONITOR FOR DIESEL ENGINES

TECHNICAL FIELD

This invention relates generally to the monitoring of engine oil in a motor vehicle and, more particularly, to a method for advising an operator of the need to change the engine oil in a direct or an indirect injection diesel engine based on oil temperature and oil contamination.

BACKGROUND OF THE INVENTION

It is known in the art relating to automotive vehicles that engine durability is directly related to the lubricating ability of the engine crankcase oil, and that its lubricating ability becomes degraded with engine operation and time. Thus, most engine and vehicle manufacturers provide their customers with oil change maintenance schedules for the point at which the engine oil should be changed. These oil change maintenance schedules are only guidelines and, depending on the engine operating conditions, the required oil change interval may be less than 3,000 miles or greater than 10,000 miles. To provide a more accurate prediction of the point at which the oil should be changed, an estimate of the extent of oil degradation and the need for an oil change for a given vehicle can be determined by electronically monitoring certain key engine operating parameters in the course of vehicle operation between oil changes. When it is determined that an oil change is required, the operator is so informed by an instrument panel indicator.

It has been shown that a direct and accurate indication of engine oil degradation can be determined by assessing two effects: (1) chemical changes that occur as a consequence of exposure of the engine oil to high or low temperatures, without regard to engine loading or other operating conditions which may only be indirectly related to oil temperature, and (2) formation of contaminants such as soot and acids that typically are produced at high load and high temperature.

Excessive degradation of the engine oil occurs at its temperature extremes. At low engine oil temperatures, typically during start-up, fuel and water can accumulate in the engine oil. Fuel and fuel reaction products can also enter the engine oil and cause a decrease in oil viscosity. This low temperature effect can occur completely independent of the load.

At high engine oil temperatures, antioxidants in the oil can become inactivated, and thus a major additive that provides chemical stability to the engine oil is no longer as effective as it was initially. As a consequence, the oil becomes more viscous and acidic due to oxidation and nitration. In addition, insoluble materials may be deposited on the engine surfaces as a varnish or sludge.

Another type of oil degradation occurs as a function of the rate at which fuel is injected into the cylinders of the diesel engine. Contaminants such as soot and acids form during incomplete combustion, typically at high temperatures and at high loads. Soot and acids that have entered the engine oil reduce the ability of the oil to prevent corrosion and increase soot-related wear. Therefore, it is desirable to provide a monitoring system that determines the need to change the engine oil based on both the degradation of the engine oil due to high and low temperature effects and the degradation due to contamination from load-related soot and acid effects.

SUMMARY OF THE INVENTION

The invention provides a method for advising an operator of a motor vehicle with a diesel engine of the need to change the oil based on a calculated rate of engine oil degradation. The rate of engine oil degradation is affected by the temperature of the oil and the amount of contaminants entering the oil at high loads. Under conditions in which both temperature effects and high load effects are occurring simultaneously, the calculated rate of degradation takes into account both effects.

The rate of degradation of the engine oil is calculated by assessing the severity of engine operation as a function of both oil temperature and oil contamination. The severity of service due to differences in the engine oil temperature is assessed by determining an engine oil temperature value over a predetermined interval that may be measured in terms of time (for example, one second) or in terms of engine revolutions (for example, 500 revolutions) and assigning a penalty factor associated with that temperature. The severity of service due to contamination is assessed by calculating an engine oil contaminant value from various engine parameters and assigning a penalty factor for that value. In general, these relationships are established experimentally for each engine design.

The duration of each given effect is assessed by monitoring the elapsed number of engine revolutions or the elapsed time. At the start of service after a reset of the oil life monitor system, the number of engine revolutions corresponding to the maximum allowed number of engine revolutions for the useful life of the engine oil is stored in the vehicle's computer memory. In each period of vehicle operation, the stored number is decreased by an effective engine revolutions value determined in relation to the product of measured engine revolutions and the penalty factors found to be associated with engine oil temperature and engine oil contamination, resulting in a remaining allowed engine revolutions value. The penalty factors increase the effective revolutions value to compensate for engine operating conditions that tend to increase degradation of the engine oil. Each time the effective engine revolutions value is calculated and subtracted from the remaining allowed engine revolutions value, a new remaining allowed engine revolutions value is stored in memory, replacing the old value. When the stored remaining allowed engine revolutions value decreases below a predetermined threshold value, a signal is sent to the driver of the vehicle that an oil change is needed.

The engine oil temperature value used in determining the oil temperature penalty factor may be measured or calculated in one of two ways, depending on whether an oil temperature value is within a warm up range or in an equilibrium range. When the oil temperature value is below a predetermined temperature, or within the warm up range, the oil temperature is calculated from the initial coolant temperature and the number of engine revolutions since the beginning of the present engine operation. Once the oil temperature has reached the predetermined temperature, or is within the equilibrium range, the oil temperature is calculated from measurements which may include engine rotational speed, vehicle speed, coolant temperature, fuel injection quantity (per cylinder) and intake air temperature. Statistical techniques are available and in common use to smooth the calculated oil temperature curve. The engine oil contamination value used in determining the oil contaminant penalty factor is calculated from the oil temperature value, fuel injection timing (crank angle), fuel injection quantity and engine rotational speed. Again, these operating conditions are available to the engine control computer and can be used in a simple linear equation to calculate a useful contamination factor to be applied to engine revolutions occurring in the test cycle. The constants of the equation are fitted statistically for each engine type based on experimental data.

In addition, in the event the engine operating conditions are not severe enough to cause the revolutions counter to expire, the indicator will be activated when the vehicle has been driven a predetermined number of miles, or the maximum mileage recommended by the vehicle manufacturer for oil change intervals.

These and other features and advantages of the invention will be more fully understood from the following description of a specific embodiment of the invention taken together with the accompanying drawings.

BRIEF DESCRIPTION OF THE DRAWINGS

The invention may be best understood by reference to a preferred embodiment and to the drawings in which.

DESCRIPTION OF THE PREFERRED EMBODIMENT

Figure 1:
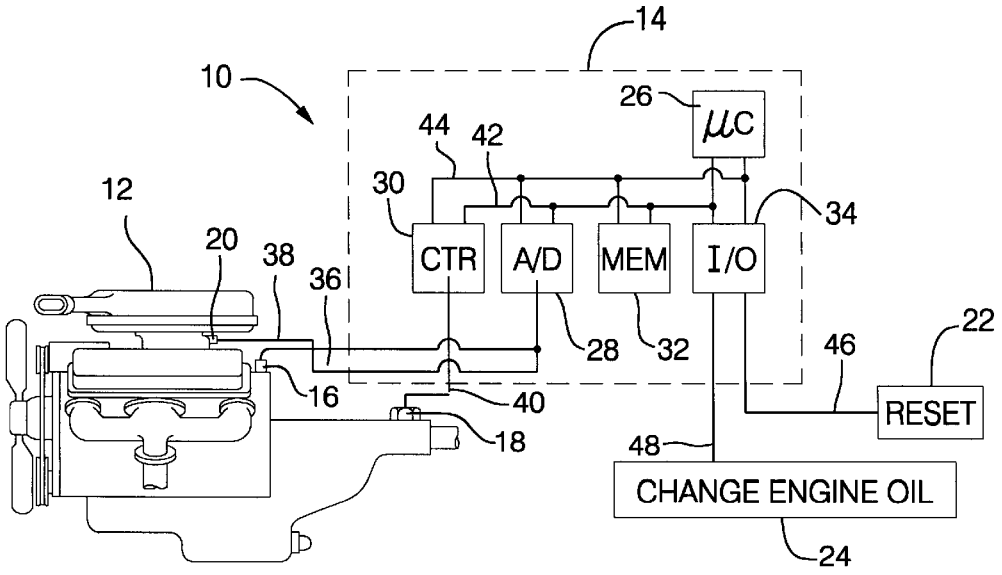
FIG. 1 is a schematic diagram of a system for indicating the point at which the oil in a diesel engine needs to be changed in accordance with the preferred embodiment.

Referring now to the FIG. 1 of the drawings in detail, numeral 10 generally indicates an oil change monitoring system connected with a motor vehicle diesel engine 12. The system 10 includes a controller 14, an engine coolant temperature sensor 16, an engine speed sensor 18, an intake air temperature sensor 20, an oil change reset 22 and an indicator 24. Generally, the controller 14 receives inputs from the sensors 16, 18, 20 and in response to those sensor inputs and other known engine parameters, such as fuel rate and intake air temperature, the controller 14 determines whether to activate the indicator 24 advising the operator of the need to change the oil. After the oil is changed, actuation of the oil change reset 22 sends a signal to the controller 14 to clear or reset certain variables used by the controller 14 to determine the degradation of the oil.

The controller 14 might typically include a microprocessor 26, an analog-to-digital (A/D) converter 28, a counter 30, a nonvolatile memory 32, and an input/output (I/O) device 34. The analog outputs of coolant temperature sensor 16 and intake air temperature sensor 20 on lines 36 and 38, respectively, are applied to the A/D converter 28 where they are converted from analog signals to digital signals and made available for acquisition via a bi-directional data bus 42. The digital pulse train output of engine speed sensor 18 is applied to counter 30 via line 40 where it is divided down to a rate of one pulse per engine revolution and made available for acquisition via the data bus 42. Elements 28–34 communicate with each other via an address and control bus 44 and the data bus 42. The output of the oil change reset 22 on line 46 is applied as an input to I/O device 34, and the digital information for controlling the operation of the indicator 24 is outputted from the I/O device 34 via line 48.

Sensors 16, 18, 20 may be conventional temperature and speed transducers. For example, coolant temperature sensor 16 may be a varistor element housed in a conductive probe positioned in the mainstream of engine coolant flow or in any location where the measured engine coolant temperature is representative of the temperature of the engine as commonly understood by those skilled in the art of vehicle engine design, and the speed sensor may be a Hall effect sensor cooperating with a toothed ferromagnetic wheel coupled to the engine crankshaft. More detailed specifications of such sensors are readily available to those skilled in the art and therefore are not supplied herein.

Generally, the method of the present invention determines the remaining useful life of the engine oil until the next oil change by monitoring engine revolutions, oil temperature and oil contamination content. Typically, if an engine is cold at start-up, oil temperature steadily increases with each engine revolution. Once the oil temperature is greater than approximately 80° C., it tends to assume a value which becomes nearly constant as a function of time or distance traveled as long as engine speed, vehicle speed, ambient temperature and fuel rate remain constant. The actual value of this substantially constant equilibrium oil temperature tends to be slightly higher than engine coolant temperature but varies with the previously mentioned factors.

Accordingly, the oil temperature is calculated in one of two ways depending on whether the oil temperature is in a warm up range or an equilibrium range. When the calculated oil temperature is in the warm up range, the oil temperature is determined from an initial engine coolant temperature and the sum of engine revolutions since the beginning of the engine start-up. When the calculated oil temperature is in the equilibrium range, the oil temperature is determined based on measurements which may include engine coolant temperature, engine speed, vehicle speed, fuel quantity and intake air temperature. Alternatively, a measured oil temperature read from an engine oil temperature sensor may be used rather than the calculated oil temperature value. The oil contamination rate is calculated from the calculated oil temperature, engine speed, fuel quantity and fuel injection timing.

The calculation of oil temperature, oil contamination and engine revolutions used to determine the remaining oil life is carried out during the time that the engine is in operation. During the entire period of operation, the calculation of remaining oil life is updated over a predetermined interval which may be measured either in terms of time or in terms of elapsed engine revolutions. As soon as the remaining useful life is updated, the next calculation of oil life begins.

The remaining useful life of the engine oil is calculated by multiplying measured engine revolutions by the penalty factors associated with engine oil temperature and engine oil contamination. The penalty factors compensate for engine operating conditions that tend to cause increased oil degradation. At the start of service after a reset of the oil life monitor system, the number of engine revolutions corresponding to the maximum allowed number of revolutions for the useful life of the engine oil is stored in the memory of the vehicle's computer. During each period of vehicle operation, the stored number is decreased by the effective engine revolutions value, resulting in a remaining allowed engine revolutions value. Each time the effective engine revolutions value is calculated and subtracted from the remaining allowed engine revolutions value, a new value for the remaining allowed engine revolutions value is stored in memory. When the stored remaining allowed engine revolutions value has decreased below a predetermined threshold value indicating the end of the useful life of the engine oil, the vehicle operator is alerted to change the oil. Also, if the maximum allowed number of traveled miles since the previous oil change, even if the remaining allowed engine revolutions have not reached the designated threshold value, a "change oil" signal will be activated.

Figure 2:
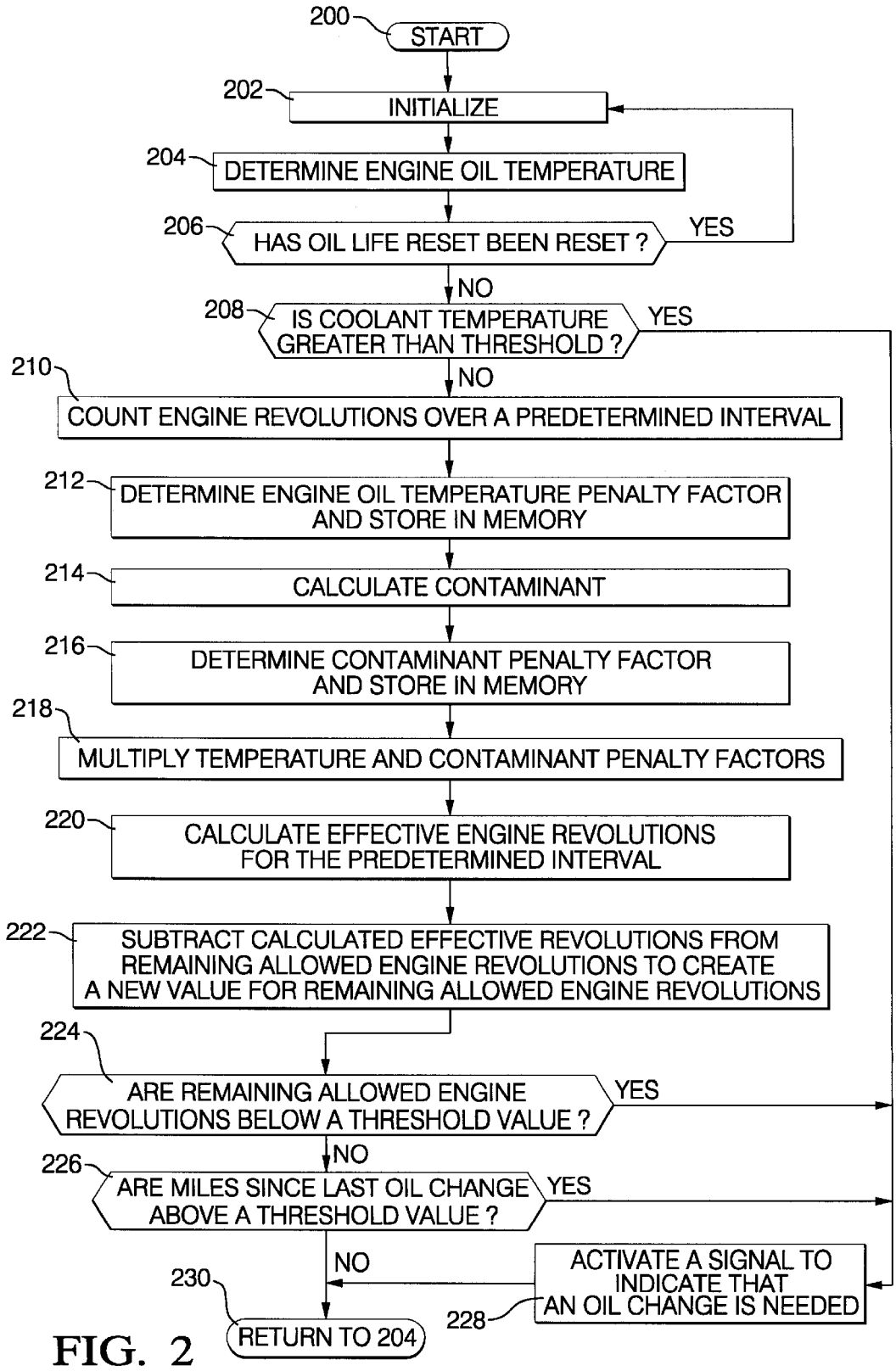

More specifically, such a method of operation is initiated at step 200 in FIG. 2 when the engine is turned on and proceeds to a step 202, initialization. As part of the initialization process, the remaining allowed engine revolutions are recalled from the computer's memory. Initialization also includes setting pointers, flags, registers and RAM variables to their starting values. Since the controller will likely perform other operations in addition to the control operations of this invention, the flow diagram is depicted as a subroutine which is periodically called in a main program.

Figure 3:
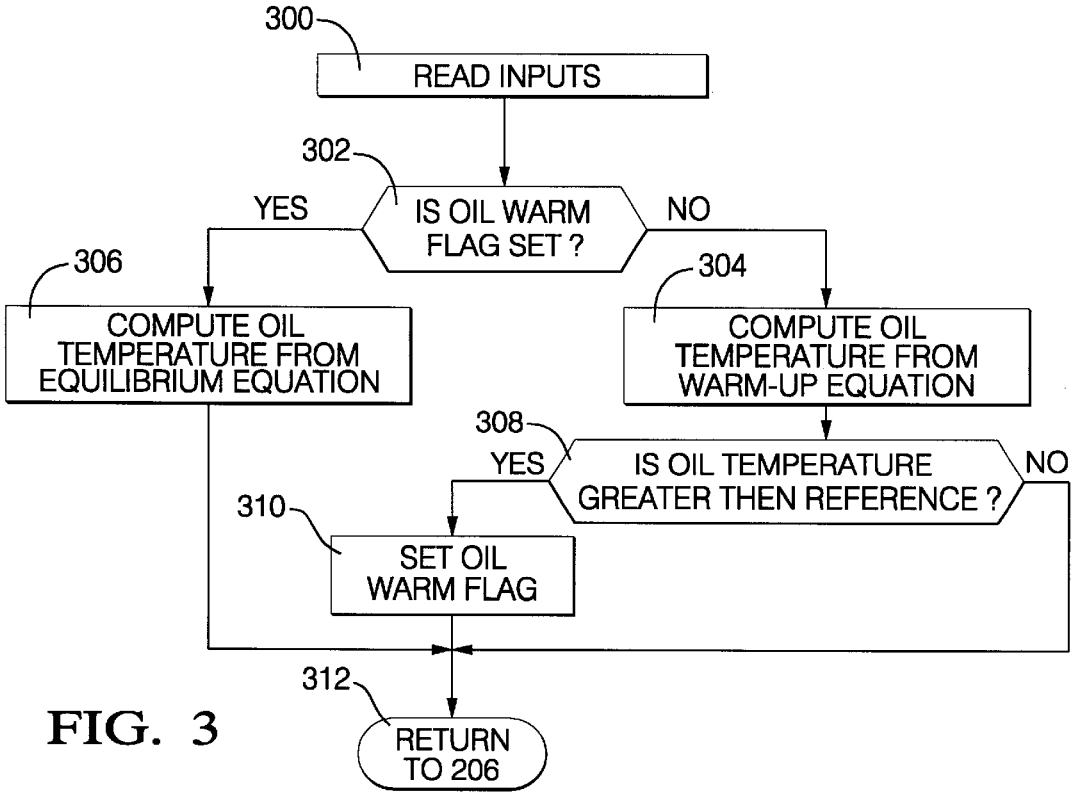
FIGS. 2 and 3 are flow diagrams illustrating a flow of operations for carrying out a method of this invention to be executed by the system of FIG. 1.

At a next step 204, the engine oil temperature value is determined by either calculating an oil temperature value by executing steps 300–312 shown in FIG. 3 or measuring an oil temperature value by reading an engine oil temperature sensor. At a next step 206, the oil life reset is checked to see if it has been reset indicating a recent oil change. If the oil life reset has been reset, the stored remaining revolutions value and the number of traveled miles are reset to their starting values at step 202. The oil life reset may be executed in several different ways. Typically, the reset may be actuated by keying in and depressing the vehicle accelerator pedal to 80% of maximum and releasing three times within five seconds with the vehicle's engine off and ignition key on. Other methods include depressing a "change-oil-reset" switch or button located within the vehicle or following some routine in a driver information system in the vehicle.

At a step 208, the coolant temperature is checked to see if it has exceeded a predetermined threshold value indicating that the engine has overheated. If the coolant temperature has exceeded the predetermined value, the change oil indicator will be activated at a step 228, otherwise the operation proceeds to a next step 210.

Figure 4:
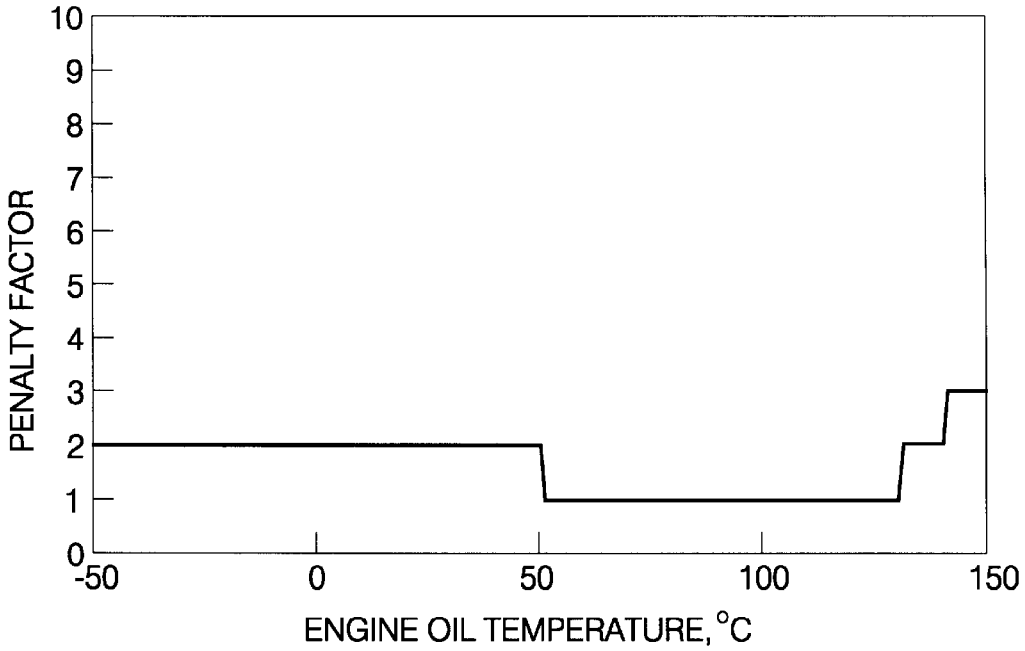
FIG. 4 is a graphical representation of the relationship between oil temperature and a penalty factor value used in this invention.

During each engine operation, a counter accumulates the number of engine revolutions over a predetermined interval (in terms of time or engine revolutions) at a step 210. Next, the oil temperature penalty factor is looked up from a table and is stored in memory at a step 212. The oil temperature penalty factor is determined from FIG. 4 which graphically depicts the assignment of penalty factors as a function of oil temperature.

Figure 5:
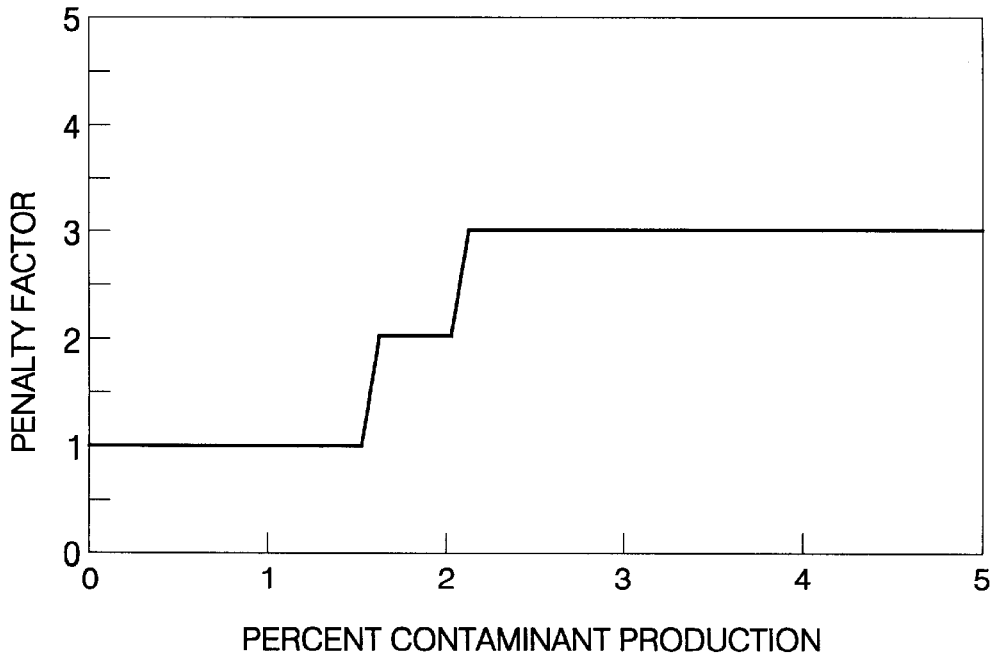
FIG. 5 is a graphical representation of the relationship between oil contamination content and a penalty factor value used in this invention.

At a step 214, the engine oil contamination value is determined according to the contamination equation, $C=k_8+k_9I_t+k_{10}F_q+k_{11}T_o+k_{12}S_e$, wherein $I_t$ is the fuel injection timing, i.e., the crank angle at which fuel injection is initiated (e.g., 30° before top dead center), $F_q$ is fuel quantity in cubic millimeters injected per cylinder, $T_o$ is the calculated oil temperature value, $S_e$ is engine rotational speed (rpm) and $k_8$, $k_9$, $k_{10}$, $k_{11}$, and $k_{12}$ are constants. In the case of a direct injection, 6.6 L, V-8 diesel engine, the values for these constants are $k_8=-2.7$, $k_9=0.2$, $k_{10}=0.03$, $k_{11}=0.02$, and $k_{12}=0.001$. These values for constants, $k_8$–$k_{12}$, were determined as the statically best fit for the above equation based on actual engine operating and corresponding oil contamination experience for the specific engine design. The engine oil contaminant penalty factor is looked up from a table and stored in memory at a step 216. The oil contamination penalty factor is determined from FIG. 5 which graphically depicts the assignment of penalty factors as a function of oil contamination content determined from various engine parameters. The penalty factors for temperature and contamination are multiplied at a step 218.

The effective engine revolutions value is determined at a next step 220 by multiplying the accumulated engine revolutions over the predetermined interval by the temperature and contamination penalty factors. Various mathematical techniques may be used to accomplish this calculation. For example, the effective engine revolutions may be summed up to a designated value before being subtracted from the remaining allowed engine revolutions value; or the summation process may occur in several steps, depending on the properties of the vehicle's computer. The effective engine revolutions value is subtracted from the remaining allowed engine revolutions value at a step 222. At a step 224, if the remaining allowed engine revolutions value is below a predetermined threshold value indicative of the end of the engine oil's useful life, a signal is activated to inform the operator to change the engine oil. For example, if the engine oil has a maximum useful life of 20,000,000 engine revolutions, and if the remaining allowed engine revolutions value has fallen below a predetermined value such as 2,000,000, then the indicator will be activated and the operator will be advised that the oil needs to be changed at a step 228, otherwise the operation proceeds to a next step 226.

Returning to step 224, if the remaining allowed engine revolutions value is not less than the predetermined threshold value, a second operation for determining the need for an oil change is performed at the step 226 by keeping track of the actual mileage driven by the vehicle and providing a change oil signal at the manufacturer's maximum recommended mileage (e.g., 7500 miles) after the last oil change regardless of the calculated oil life value. If the maximum allowed number of miles of travel has not been achieved, the operation will return to the main program at a step 230.

Returning to step 204, the oil temperature value used in determining the oil temperature penalty factor may be calculated by executing the steps 300–312, or the oil temperature may be measured. To calculate oil temperature, at step 300 the inputs of the sensors are read. These inputs include at least the outputs of the intake air temperature sensor, coolant temperature sensor and engine rotational speed sensor and may include others as described herein, for example, vehicle speed.

The coolant temperature output is first read at the beginning of each period of engine operation and stored as $T_{ic}$, an initial coolant temperature. The coolant temperature output is also read at any time requiring the value $T_c$, a present coolant temperature. The engine speed sensor is used to determine the number of revolutions since the beginning of engine operation, $R_e$, as well as the value of engine rotational speed in rpm $S_e$. The calculated values of the fuel quantity injected per cylinder ($mm^3$), $F_q$, and fuel injection timing (crank angle), $I_t$, are dependent upon engine operation conditions and are determined by the controller performing known calculations.

At step 302, it is determined whether an oil warm up flag has been set indicating whether the oil temperature value is within a warm up range or an equilibrium range. If the oil warm up flag has not been set, then the oil temperature is within the warm up range and the oil temperature is calculated according to the warm up equation, $T_o=T_{ic}+k_1R_e$ at a step 304, wherein $T_{ic}$ is the initial coolant temperature at engine start up, $R_e$ is the sum of engine revolutions since engine start up and $k_1$ is a constant equal, for example, to 0.005. At a step 308, it is determined whether the calculated oil temperature is greater than a predetermined value, e.g., 80° C., indicating that the oil temperature has exceeded the warm up range. If the calculated value is (Treater than the predetermined value, then the oil warm up flag is set at a step 310 and, if not, the oil warm up flag is left unchanged. At a step 312, the operation is returned to step 206.

Figure 6:
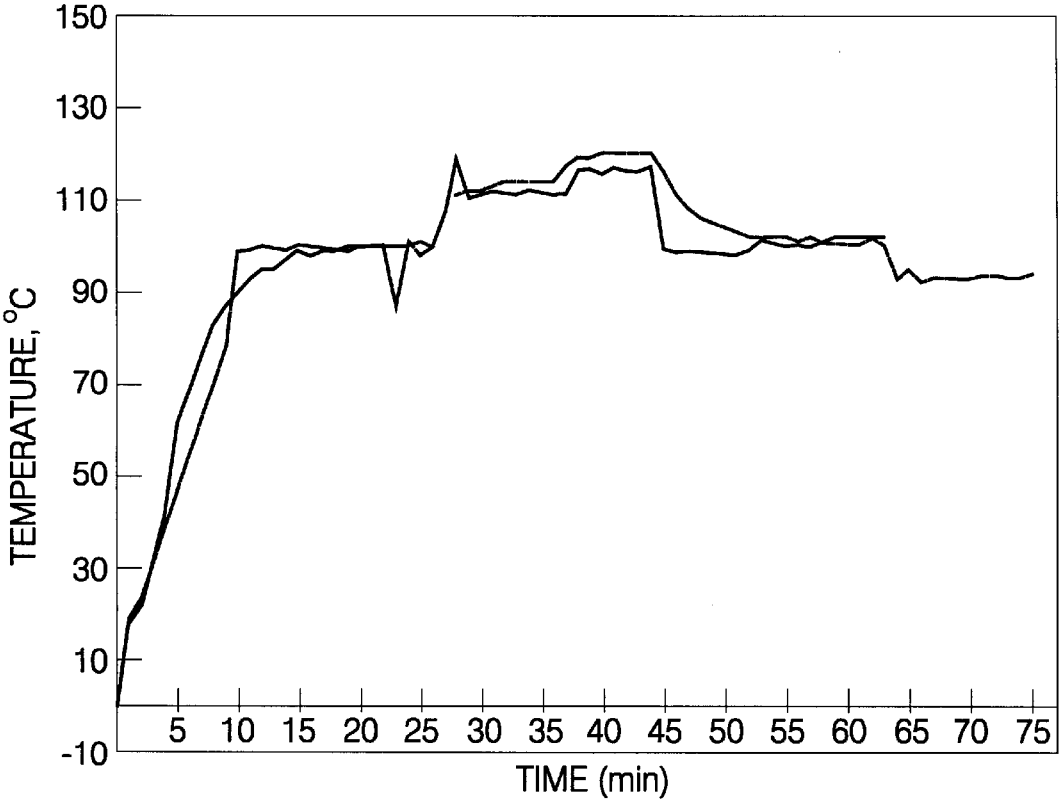
FIG. 6 is a graphical representation of the relationship between an actual sensed engine oil temperature and an engine oil temperature as calculated by the method of the present invention.

Returning to step 302, if the warm up flag has been set, the oil temperature is within the equilibrium range and the oil temperature is calculated according to the equilibrium equation, $T_o=k_2+k_3S_e+k_4T_c+k_5F_q-k_6T_a\pm k_7V_sV$, at a step 306, wherein $S_e$ is engine rotational speed, $T_c$ is the coolant temperature, $F_q$ is fuel quantity, $T_a$ is the air intake temperature, $V_s$ is the vehicle speed, and $k_2$, $k_3$, $k_4$, $k_5$, $k_6$ and $k_7$ are constants. Typical values of these constants are $k_2=-9.0$, $k_3=0.012$, $k_4=0.95$, $k_5=0.21$. $k_6=0.001$ and $k_7=0.01$. $k_7V_s$ is an optional term for calculating and may be added to or subtracted from $T_o$, depending on the characteristics of a given engine. FIG. 6 illustrates the correlation between the calculated engine oil temperature, as determined with the method of this present invention, and measured engine oil temperature which is excellent. After calculating the oil temperature, the operation returns back to step 206. The above process sequence is suitably repeated each second or so of engine operation.

While the invention has been described by reference to a certain preferred embodiment, it should be understood that numerous changes could be made within the spirit and scope of the inventive concepts described. Accordingly it is intended that the invention not be limited to the disclosed embodiment, but that it have the full scope permitted by the language of the following claims.

What is claimed is:

1. In a motor vehicle having a direct or an indirect injection diesel engine containing lubricating oil which has a useful life that varies in accordance with engine operating conditions, a method for advising the operator of the vehicle of the need to change oil, such method comprising the steps of:

periodically calculating an effective engine revolutions value over predetermined intervals during a present engine operation in accordance with a product of measured engine revolutions and engine oil temperature and engine oil contaminant penalty factors which operate to increase the effective engine revolutions value to compensate for engine operating conditions that tend to cause increased degradation of the engine oil, the oil temperature and oil contaminant penalty factors being determined as a function of engine oil temperature and engine oil contaminant values, respectively;

decreasing a stored remaining allowed revolutions value indicative of the remaining number of engine revolutions allowed for the useful life of the engine oil by subtracting the calculated effective engine revolutions value; and actuating an indicator advising the operator that the engine oil needs to be changed when the stored remaining allowed revolutions value falls below a predetermined threshold value indicative of the end of the useful life of the engine oil.

2. A method as in claim 1 further comprising the step of calculating the engine oil temperature value in accordance with engine parameters prior to calculating the effective engine revolutions value.

3. A method as in claim 1 further comprising the step of determining the engine oil temperature value by measuring an engine oil temperature from an engine oil temperature sensor prior to calculating the effective engine revolutions value.

4. A method as in claim 1 further comprising the step of calculating the engine oil contaminant value in accordance with an oil temperature value, fuel injection timing, fuel quantity and engine rotational speed prior to calculating the effective engine revolutions value.

5. A method as in claim 2 wherein the step of calculating the engine oil temperature value includes the steps of:

when the engine oil temperature value is in a warm up range, calculating the oil temperature in accordance with a measured initial coolant temperature at the beginning of a current engine operation and a sum of engine revolutions since the beginning of the current engine operation; and when the engine oil temperature value is in an equilibrium range, calculating the oil temperature in accordance with a measured coolant temperature, engine rotational speed, fuel quantity, intake air temperature and vehicle speed.

6. A method as in claim 2 wherein the step of calculating the engine oil temperature value includes the steps of:

when the engine oil temperature value is in a warm up range, calculating the oil temperature in accordance with a warm up equation $T_o=T_{ic}+k_1R_e$ wherein $T_{ic}$ is an initial coolant temperature at the beginning of a current engine operation, $R_e$ is sum of the engine revolutions since the beginning of the current engine operation and $k_1$ is a constant; and when the engine oil temperature value is within an equilibrium range, calculating the oil temperature in accordance with an equilibrium equation $T_o=k_2+k_3S_e+k_4T_c+k_5F_q-k_6T_a\pm k_7V_s$ wherein $S_e$ is engine rotational speed, $T_c$ is a coolant temperature, $F_q$ is fuel quantity, $T_a$ is an air intake temperature, $V_s$ is vehicle speed, and $k_2$, $k_3$, $k_4$, $k_5$, $k_6$ and $k_7$ are constants.

7. A method as in claim 4 wherein the step of calculating the engine oil contaminant value includes the steps of:

calculating the engine oil contaminant value, C, from an equation $C=k_8+k_9I_t+k_{10}F_q+k_{11}T_o+T_o+k_{12}S_e$, wherein $I_t$ is fuel injection timing, $F_q$ is fuel quantity, $T_o$ is the calculated oil temperature value, $S_e$ is engine rotational speed, and $k_8$, $k_9$, $k_{10}$, $k_{11}$ and $k_{12}$ are constants.

* * * * *